United States Patent [19]

Jones

[11] Patent Number: 4,941,688

[45] Date of Patent: Jul. 17, 1990

[54] PERIODIC EVENT RECORDER

[76] Inventor: Truman Jones, 1204 Douglas St., Big Spring, Tex. 79720

[21] Appl. No.: 437,372

[22] Filed: Nov. 15, 1989

[51] Int. Cl.[5] ..... B42D 15/00; G09F 9/00

[52] U.S. Cl. ..... 283/72; 283/900; 116/325; 116/326

[58] Field of Search ..... 283/72, 67, 100, 103, 283/104, 105, 102, 99, 73, 900; 116/326, 325, 308, 227

[56] References Cited

U.S. PATENT DOCUMENTS

| | | | |
|---|---|---|---|
| 1,790,994 | 2/1931 | McCook | 116/326 |
| 2,179,168 | 11/1939 | Alexander | 283/2 |
| 4,148,273 | 4/1979 | Hollingsworth et al. | 116/325 |
| 4,240,649 | 12/1980 | Weber | 283/23 |
| 4,241,943 | 12/1980 | Malinovitz | 283/901 |
| 4,282,824 | 8/1981 | Lafferty | 116/325 |
| 4,745,875 | 5/1988 | Timleck | 116/326 |
| 4,752,087 | 6/1988 | Weisbach | 283/900 |
| 4,815,767 | 3/1989 | Lambert | 283/67 |
| 4,830,407 | 5/1989 | Sadler, Jr. et al. | 283/900 |
| 4,881,758 | 11/1989 | Ben-David | 283/100 |

*Primary Examiner*—Paul A. Bell
*Assistant Examiner*—Hwei-Siu Payer
*Attorney, Agent, or Firm*—Ross, Howison, Clapp & Korn

[57] ABSTRACT

A period event recorder comprising a label, indicia on the label corresponding to a desired time or frequency interval; a porous substrate attached to the underside of the label; means for attaching the porous substrate to an object associated with, related to, or nearby the site for performance of a desired task or event; and a stylus adapted to puncture that portion of the label bearing indicia corresponding to that particular performance of the desired task or event.

19 Claims, 1 Drawing Sheet

PERIODIC EVENT RECORDER

TECHNICAL FIELD

This invention relates to apparatus useful for recording the passage of preselected or defined periods of time in connection with the performance of a task needed to be performed on a periodic basis such as, for example, taking medicine, paying bills, performing inspections, servicing equipment, or the like. One aspect of the invention relates to apparatus that can be conveniently attached to and supported by an object used in performing the desired task.

BACKGROUND ART

Periodic event recorders are previously known, having been disclosed for example in the following U.S. Pat. Nos.: 2,179,168; 3,818,858; 4,241,943; 4,752,087; 4,815,767; and 4,830,407.

U.S. Pat. Nos. 2,179,168, 4,241,943, 4,752,087 and 4,830,407 all disclose the use of cards or labels comprising a substrate and an overlying mask such as a sticker or coating that is scraped away or otherwise removed in conjunction with the performance or occurrence of a periodic event. Indicia identifying desired periodic intervals by one-to-one correspondence or some other similarly useful criteria are applied to either the substrate or the masking material. If applied to the substrate, the masking material is removed in conjunction with performance or occurrence of the periodic event to reveal the underlying indicia. If applied as part of the masking material, the masking material is removed in conjunction with performance or occurrence of the periodic event to reveal a contrasting substrate, thereby evidencing, for example, performance of a desired task.

U.S. Pat. No. 3,818,858 discloses means for indicating the date on which food products or other perishable material are placed into a container for subsequent refreshing of the memory of a housewife when looking into a refrigerator.

U.S. Pat. No. 4,815,767 discloses apparatus for use in taking medicine at periodic intervals that indicates the times of the day, days of the week and type of medication that should be taken. Distinctively shaped and/or colored stickers are desirably applied to a chart marked with appropriate periodic indicia, and matching stickers are applied to the corresponding medicament.

Notwithstanding the periodic event recorders previously disclosed, however, a periodic event recorder is needed that is simplistic in design, that can be easily attached to an object related to occurrence of a periodic event or the performance of a desired task, and that can be conveniently marked to clearly indicate occurrence of the event or performance of the task.

SUMMARY OF THE INVENTION

According to a preferred embodiment of the present invention, a periodic event recorder is provided that comprises a label; indicia on the label which correspond to a desired time or frequency interval; a porous substrate attached to the underside of the label; means for attaching the porous substrate to an object associated with, related to, or nearby the site for performance of a desired task or event; and a stylus adapted to puncture that portion of the label bearing the indicia corresponding to that particular performance of the desired task or event.

According to one embodiment of the invention, the subject periodic event recorder comprises a label marked with the hours of the day.

According to one embodiment of the invention, the subject periodic event recorder comprises a label marked with the days of the week.

According to one embodiment of the invention, the subject periodic event recorder comprises a label marked with the days of the month.

According to one embodiment of the invention, the subject periodic event recorder comprises a label marked with the months of the year.

According to one particularly preferred embodiment of the invention, the porous substrate material attached to the underside of the label is a layer of polymeric foam material, and most preferably, foamed polypropylene.

According to another embodiment of the invention, the underside of the porous substrate is impregnated or coated with a pressure sensitive adhesive. A removable cover layer is attached by the adhesive to the underside of the porous substrate during manufacture of the periodic event recorder and is removed at the use site prior to attaching the periodic event recorder to another object.

BRIEF DESCRIPTION OF THE DRAWINGS

The apparatus of the invention is further described and explained in relation to the following drawings wherein.

Like reference numerals are used to indicate like parts in all figures of the drawings.

DESCRIPTION OF THE PREFERRED EMBODIMENTS

Figure 1:
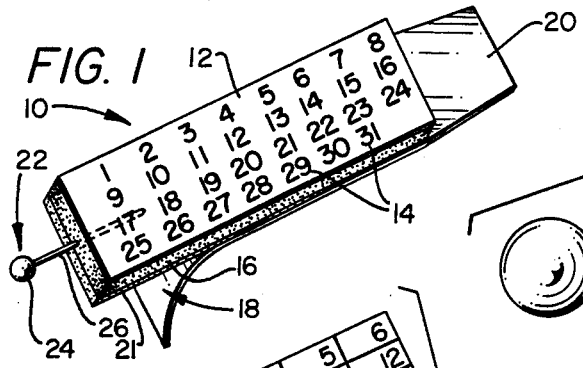
FIG. 1 is a perspective view of a preferred periodic event recorder of the invention.

Referring to FIG. 1, periodic event recorder 10 of the invention preferably comprises label 12 bearing indicia 14, porous substrate 16, removable cover layer 18 with tab 20, and stylus 22.

Label 12 is preferably made of paper, coated paper, or plastic, and is sized commensurate with the application for which it is intended. The thickness and material label 12 is preferably such that label 12 can be punctured by stylus 22 without the application of excessive force.

Figure 5:
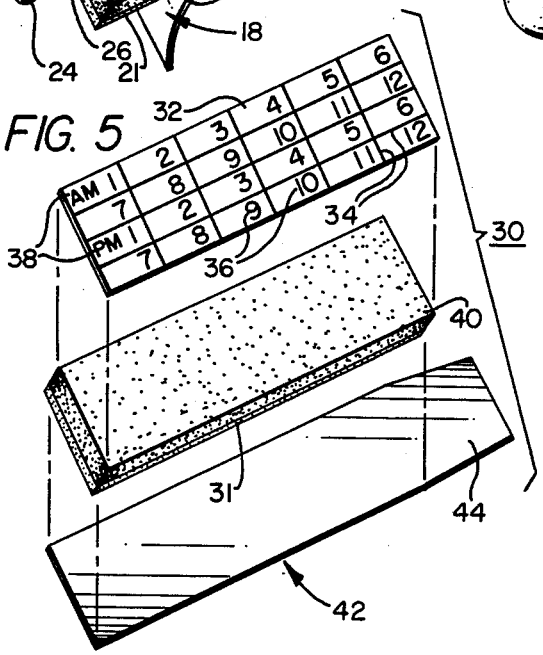
FIG. 5 is an exploded perspective view of another preferred embodiment of the invention (stylus not shown) in which the label portion, substrate portion and cover layer portion are separated for the purposes of better illustrating and explaining the invention.
Figure 4:
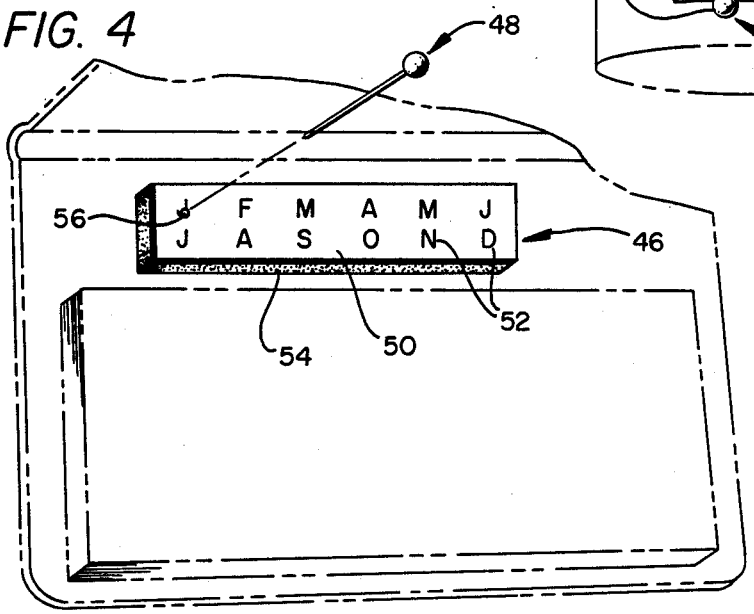
FIG. 4 is a perspective view depicting another preferred embodiment of a periodic event recorder made in accordance with the present invention applied to a check book (shown in phantom outline), further showing the manner in which the stylus portion of the invention is used to puncture the label portion to indicate the performance or passage of a periodic task or event.

Indicia 14 are preferably applied to the upward facing surface of label 12 by printing, lamination, as decals, or in any other similarly effective manner. As shown in FIG. 1, indicia 14 comprise thirty-one separate Arabic numerals generally corresponding to the number of days in a month. It is understood, however, that different types and configurations of indicia can also be used within the scope of the invention. Thus, for example, FIG. 4 depicts an array of twelve letters corresponding to the initial letters of each of the twelve months of the year. FIG. 5 depicts an array of indicia comprising two sets of twelve numerals each generally corresponding to two twelve hour periods (further designated by "AM" and "PM") in a day. The individual elements of the array of indicia depicted in the embodiment of the invention shown in FIG. 5 are further differentiated by grid lines 34 disposed therebetween. Indicia in the form of symbols other than letters or numerals can also be used for particular purposes within the scope of the invention.

Porous substrate 16 preferably comprises a polymeric foam material, most preferably foamed polypropylene. It will be understood, however, that other materials such as foamed polystyrene or even corrugated paper can also be used as porous substrate 16 within the scope of the invention. As used herein, the term "porous" means sufficiently penetrable that stylus 22 can be inserted through label 12 and into the porous material when puncturing label 12 to record the desired periodic event, and sufficiently penetrable that stylus 22 can be inserted into the porous material from one edge thereof for storage between episodes of recording a periodic event.

Figure 2:
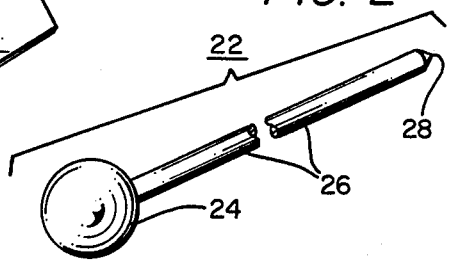
FIG. 2 is an enlarged perspective view, partially broken away, of a preferred stylus for use in the periodic event recorder of the invention.
Figure 3:
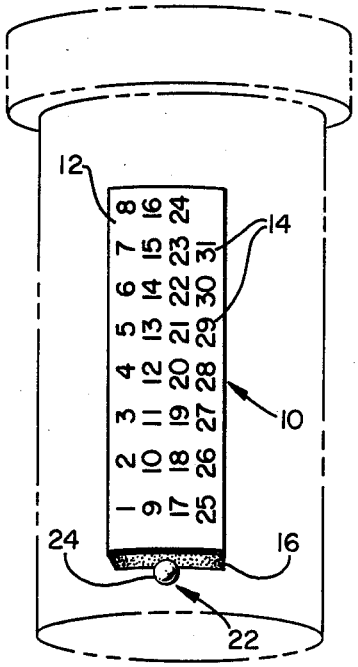
FIG. 3 is a perspective view depicting the periodic event recorder of FIG. 1 applied to a medicine bottle (shown in phantom outline)

According to a preferred embodiment of the invention, when used in applications as depicted in FIGS. 3 and 4 of the drawings, porous substrate 16 is coextensive with the length and width of label 12, and has a thickness ranging from about 1/16 inch to about 3/16 inch, although it will be appreciated that the thickness of substrate 16 can vary according to factors such as the material utilized, the intended use of periodic event recorder 10, and the like. According to a particularly preferred embodiment of the invention, the thickness of porous substrate 16 is sufficient that shaft portion 26 of stylus 22 (as shown in FIG. 2) can be inserted into porous substrate 16 from one edge thereof as shown in FIG. 1 for storage between uses as referred to above.

Referring again to FIG. 1, removable cover layer 18 preferably comprises a strip of coated paper or polymeric film adapted to releasably adhere to the underside of porous substrate 16. Cover layer 18 preferably comprises an adherent portion that is coextensive with the bottom surface of porous substrate 16, and a further nonadherent tab 20 adapted to be grasped when removing cover layer 18 from substrate 16. Cover layer 18 preferably remains in place until the user desires to apply periodic event recorder 10 to an object, at which time the user grasps tab 20, peels away cover layer 18, and firmly presses on label 12, thereby forcing porous substrate 16 tightly against the surface of the object to which label 12 is to be applied.

The particular adhesive utilized to attach label 12 to porous substrate 16 will depend of course upon the materials selected for use as those elements of the invention, although satisfactory adhesives for use in this application are commercially available and generally well known. Generally speaking, the adhesive material 21 used to attach cover layer 18 to the underside of porous substrate 16 will preferably be a releasable, pressure sensitive adhesive, whereas the adhesive used to attach label 12 to the upper surface of porous substrate 16 will preferably be a more permanent, nonreleasable adhesive.

Referring to FIG. 2, stylus 22 preferably comprises head 24, shaft 26 and point 28. Stylus 22 can be satisfactorily fabricated from metal or plastic, provided that shaft 26 is sufficiently rigid and appropriately shaped to permit penetration through label 12 and into porous substrate 16. The diameter of shaft 26 should be small enough to be insertable into one edge of porous substrate 16 as shown in FIG. 1, but should be sufficiently large that the puncture site where stylus 22 is inserted through label 12 will be readily visible to the user. Head 24 should be sufficiently large to enable it to be readily grasped by the fingers of the user. Point 28 is desirably relatively blunt, as might be achieved by making the beveled surface at the end thereof inclined approximately 45 degrees from the longitudinal axis through shaft 26. The use of a blunt point will reduce the risk of unintentional injury to the user or others, will still enable stylus 22 to puncture label 12 and penetrate substrate 16, and should facilitate manufacture, especially if stylus 22 is made of injection molded plastic.

Referring to FIG. 3, periodic event recorder 10 can be applied to a medicine bottle (shown in phantom outline) by removing cover layer 18 and pressing label 12 against the side of the bottle. Head 24 of stylus 22 is shown protruding from the downward facing edge of periodic event recorder 10, having been stored there pending use. Label 12, bearing thirty-one sequential numeric indicia generally corresponding to the number of days in a month, illustrates an embodiment of the invention that might be used with a medicament requiring a single dose per day. At the time of taking the prescribed dose, the user would remove stylus 22 from porous substrate 16, puncture label 12 at or near the indicia corresponding to the appropriate day of the month, and then reinsert stylus 22 into porous substrate 16 pending the next use.

Referring to FIG. 4, an embodiment of the subject invention is shown in which periodic event recorder 46 comprises label 50 marked with or bearing indicia 52, porous substrate 54 disposed beneath label 50, and stylus 48 removed from porous substrate 54 and positioned as is would be immediately after puncturing label 50 at point 56 over the indicia "J" corresponding to the month January. As shown in FIG. 4, periodic event recorder 46 has been applied to a surface on the inside of a checkbook (shown in phantom outline, partially broken away) in a position where it might serve as a reminder to make some required periodically recurring payment.

Referring to FIG. 5, periodic event recorder 30 comprises label 32 having grid 34 and indicia 36 and 38 marked thereon, porous substrate 40 disposed thereunder and adhered thereto (shown exploded for illustrative purposes), and cover layer 42 with tab 44 adapted for removal from the underside of porous substrate 40 when periodic event recorder 30 is applied to another object using adhesive layer 31. To simplify the illustration in FIG. 5, no stylus element is shown, although it is understood that the embodiment of FIG. 5 is also intended for use with a stylus as previously described.

In addition to the preferred embodiments specifically described herein, it will be understood and appreciated that the periodic event recorder of the invention can be succcessfully used by applying such recorders to billfolds, briefcases, desks, wrist bands, bedside tables, medicine cabinets, dressing tables, and the like.

The subject daily periodic event recorders can also be used to record many other events including, for example, security checks, meter readings, ministering to others, plant care, animal care, discharge of duties, and the like.

The subject monthly periodic event recorders can also be used to record many other events including, for example, installment payments, interest payments, rental payments, accounts payable, accounts receivable, notes payable, notes receivable, rents receivable, dividends receivable, interest receivable, anniversaries, birthdays, wages payable, wages receivable, royalties payable, royalties receivable, and the like.

Any of the embodiments of the periodic event recorder disclosed herein can also be used for repeated cycles through the indicia by allowing sufficient space beside each indicia and by using a sufficiently small stylus that a plurality of distinct and identifiable punctures can be made beside each of the indicia. Thus, for example, one might mark a label with individual indicia disposed inside a rectangular grid and use the label for four cycles through the indicia by puncturing the label at different corners of the box around each of the indicia on successive cycles through the indicia.

Better visibility of the puncture through the label that is made by the stylus can also be achieved by using a porous, penetrable substrate material that is brightly colored, or at least colored differently than any element of the label, such as any grid or indicia printed on the label.

Other alterations and modifications of the invention will become apparent to those of ordinary skill in the art upon reading this disclosure in conjunction with the accompanying drawings, and it is intended that the scope of the invention be limited only by the broadest interpretation of the appended claims to which the inventor is legally entitled.

I claim:

1. A periodic event recorder comprising a label, indicia on the label which correspond to a desired time or frequency interval, a penetrable substrate attached to the underside of the label, means for attaching the underside of the penetrable substrate to an object associated with performance of a desired task, and a stylus adapted to puncture that portion of the label bearing the indicia corresponding to performance of the desired task at a particular time or frequency interval.

2. The periodic event recorder of claim 1 wherein the indicia on the label correspond to the hours of a day.

3. The periodic event recorder of claim 1 wherein the indicia on the label correspond to the days of a week.

4. The periodic event recorder of claim 1 wherein the indicia on the label correspond to the days of a month.

5. The periodic event recorder of claim 1 wherein the indicia on the label correspond to the months of a year.

6. The periodic event recorder of claim 1 wherein said penetrable substrate further comprises a layer of foamed polymeric material.

7. The periodic event recorder of claim 6 wherein said foamed polymeric material comprises foamed polypropylene.

8. The periodic event recorder of claim 6 wherein said foamed polymeric material comprises foamed polystyrene.

9. The periodic event recorder of claim 1 wherein said penetrable substrate is corrugated paper.

10. The periodic event recorder of claim 1 wherein the underside of said penetrable substrate is coated with a pressure sensitive adhesive.

11. The periodic event recorder of claim 10 wherein said pressure sensitive adhesive is covered by a removable cover layer.

12. The periodic event recorder of claim 11 wherein said removable cover layer comprises a tab that extends beyond said label.

13. The periodic event recorder of claim 11 wherein said removable cover layer comprises coated paper.

14. The periodic event recorder of claim 11 wherein said removable cover layer comprises polymeric film.

15. The periodic event recorder of claim 1 wherein said stylus comprises a head, shaft and blunt point.

16. The periodic event recorder of claim 1 wherein all or a portion of said stylus is molded from a polymeric material.

17. The periodic event recorder of claim 1 wherein said substrate is colored differently than the label or the indicia on the label.

18. The periodic event recorder of claim 1 wherein the label comprises a grid separating the indicia.

19. The periodic event recorder of claim 18 wherein the substrate is colored differently than the grid.

* * * * *